US007270328B1

(12) United States Patent
Parrales

(10) Patent No.: US 7,270,328 B1
(45) Date of Patent: Sep. 18, 2007

(54) TWO PLAYER GAMEBOARD APPARATUS

(75) Inventor: Edwin Peraza Parrales, Jardines (CR)

(73) Assignee: As Majesty S.A., San Jose (CR)

( * ) Notice: Subject to any disclaimer, the term of this patent is extended or adjusted under 35 U.S.C. 154(b) by 19 days.

(21) Appl. No.: 11/178,491

(22) Filed: Jul. 12, 2005

(51) Int. Cl.
*A63F 3/00* (2006.01)

(52) U.S. Cl. ..... 273/260; 273/287

(58) Field of Classification Search ..... 273/260, 273/261, 236, 287; D21/363, 364, 348, 368, D21/248
See application file for complete search history.

(56) References Cited

U.S. PATENT DOCUMENTS

| | | | | |
|---|---|---|---|---|
| 384,195 | A | 6/1888 | Duryea | |
| 1,704,819 | A | 3/1929 | Beaman | |
| 3,533,627 | A | 10/1970 | Deffenbaugh et al. | |
| 3,652,091 | A | 3/1972 | Zubrin et al. | |
| 3,920,247 | A | 11/1975 | Jenkins et al. | |
| 3,963,242 | A | 6/1976 | Treugut et al. | |
| 3,964,747 | A | 6/1976 | Balmforth et al. | |
| 4,215,866 | A * | 8/1980 | Shimizu | 273/275 |
| 4,515,370 | A | 5/1985 | Garcia | |
| 5,014,995 | A | 5/1991 | Woodward | |
| 5,403,012 | A | 4/1995 | Stein | |
| 5,570,887 | A | 11/1996 | Christie, Jr. | |
| 5,582,410 | A | 12/1996 | Hunt | |
| 5,901,957 | A | 5/1999 | Leyva et al. | |
| 6,070,871 | A | 6/2000 | Wilson et al. | |
| 6,416,056 | B1 | 7/2002 | Knieriemen | |
| 2002/0105143 | A1 * | 8/2002 | Elliott et al. | 273/285 |

FOREIGN PATENT DOCUMENTS

| | | | |
|---|---|---|---|
| ES | 2114414 | A1 | 5/1998 |
| GB | 616572 | A | 1/1949 |
| GB | 620529 | A | 3/1949 |

OTHER PUBLICATIONS

International Search Report dated Dec. 11, 2006 in PCT application No. PCT/CR2006/000005, filed Jul. 12, 2006 with Written Opinion in Spanish Language (5 pages).
International Search Report dated Dec. 11, 2006 in PCT application No. PCT/CR2006/000005, filed Jul. 12, 2006 (3 pages).

* cited by examiner

*Primary Examiner*—Vishu Mendiratta
(74) *Attorney, Agent, or Firm*—Shlesinger, Arkwright & Garvey LLP.

(57) ABSTRACT

A two player game apparatus comprising a hexagonal gameboard with six major equilateral triangular segments each of which is defined by sixteen equilateral minor triangles. There are two adjacent and two opposite adjacent major segments each having game piece locator indicia on the first twelve of the equilateral minor triangles starting at the base of the segment and extending towards the center point of the board leaving the remaining four minor triangles nearest the center point free of indicia with the minor triangles being of two alternating colors and including two different colored sets of twenty-four game pieces including eight different valued pieces located on the locator indicia.

3 Claims, 4 Drawing Sheets

TWO PLAYER GAMEBOARD APPARATUS

FIELD OF THE INVENTION

This invention relates to a foldable hexagonal gameboard apparatus on which the two different colored sets of twenty-four game pieces are each positioned opposite to each other on two adjacent major segments.

BACKGROUND OF THE INVENTION

Hexagonal gameboards for checkers and chess like games have been known for many years as shown in U.S. Pat. Nos. 1,704,819 Beaman; 3,963,242 Trueget et al.; Woodard 5,014,995; Deffenbaugh et al. 3,533,627; Hunt 5,582,410; Wilson 6,070,871; and Knieriemen 6,416,056.

Various other board games of chess or checker-type strategies are well known such as Garcia U.S. Pat. No. 4,515,370; Stein U.S. Pat. No. 5,403,012; Christie, Jr. U.S. Pat. No. 5,570,887 and Leyva et al. U.S. Pat. No. 5,901,957.

All of the above patents apply various strategies and various pieces to obtain a challenging board game. In some instances two or more players can become involved.

OBJECTS AND SUMMARY OF THE INVENTION

It is object of this invention to provide a two player board game which reflects elements of medieval European culture and military conflict.

Another object of this invention is to provide an improved hexagonal board game in which the hexagonal board is foldable into a diamond shape.

Yet a further object of this invention is to provide an improved board game which includes plural playing pieces having different values and patterns of movement so as to present a high degree of challenge to the player.

Still another object of this invention is to provide an improved board game in which play of certain pieces is determined by alternating colors of the tessellations of the board.

A further object of this invention is to provide an improved board game in which individual opposing playing pieces come involved in a prolonged battle involving an alternating series of steps to resolve the outcome of the battle.

Yet a further object of this invention is to provide an improved board game which is inexpensive and durable and readily manufactured.

Another object of this invention is to provide a board game which has some of the challenges of classic chess.

A further object of this invention is to provide a board game in which some of the moves are similar to those of chess while other moves are new and novel.

A still further object of this invention is to provide a two player game which is interesting, challenging and enjoyable as compared to other conventional type board games.

In summary, this invention relates to a two player game apparatus using a hexagonal gameboard with each player having twenty-four game pieces eight of which are of different value as to movement capabilities on the playing field which has triangular places for positioning of the pieces and which triangular areas are alternately colored to enhance the movement of the various valued pieces.

Other objects and advantages of this invention will be apparent from the following drawings and detailed description.

BRIEF DESCRIPTION OF THE DRAWINGS

FIGS. 1 THROUGH 6

In FIG. 1, the gameboard G comprising 6 major triangular segments A, B, C, D, E and F. Each of the major triangular segments A, B, C, D, E and F comprise 16 minor equilateral triangular segments 2 all of which are of equal size. The minor triangular segments 2 are in contrasting colors 4 and 6. Segments A and B have indicia 8, 10, 12, 14, 16, 18, 20 and 22 for positioning of the individual game pieces (not shown). The game pieces comprise seven different pieces including a Kingdom piece positioned at 8. A King piece positioned at 10. Two Princesses pieces positioned at 12. Two Princes positioned at 14. Two Wizard pieces positioned at 16. Two Monk pieces positioned at 18. Eight Archer pieces positioned at 20. And six Squire pieces positioned at 22. The major triangular segments D and E have indicia similar to the major triangular segments A and B for positioning the opponent pieces in the opposing manner as shown in FIG. 1 in which the Kingdom piece and the King piece are juxtaposed as illustrated. The opponent pieces are of a different color from challenger pieces. Although not shown in the drawings, the major segments A, B, C, D, E and F will have their minor triangular segments 2 numbered 1-16 beginning at the apex with number 1 for purposes of recording the position of the player pieces for future strategy reference as well as computer play. The total number of minor triangles on the board is 96.

Board segment divide lines 24, 26 and 28 are also in some instances fold lines.

Only two adjacent and two opposite to the two adjacent major triangular segments AB and DE have game piece indicia 8, 10, 12, 14, 16, 18, 20, and 22 and on the first four of rows only beginning at the triangular segments AB and DE bases.

The last three rows of the minor triangles 2 of major triangular segments AB and DE have no indicia nor do any of the major triangular segments C and F.

Figure 1:
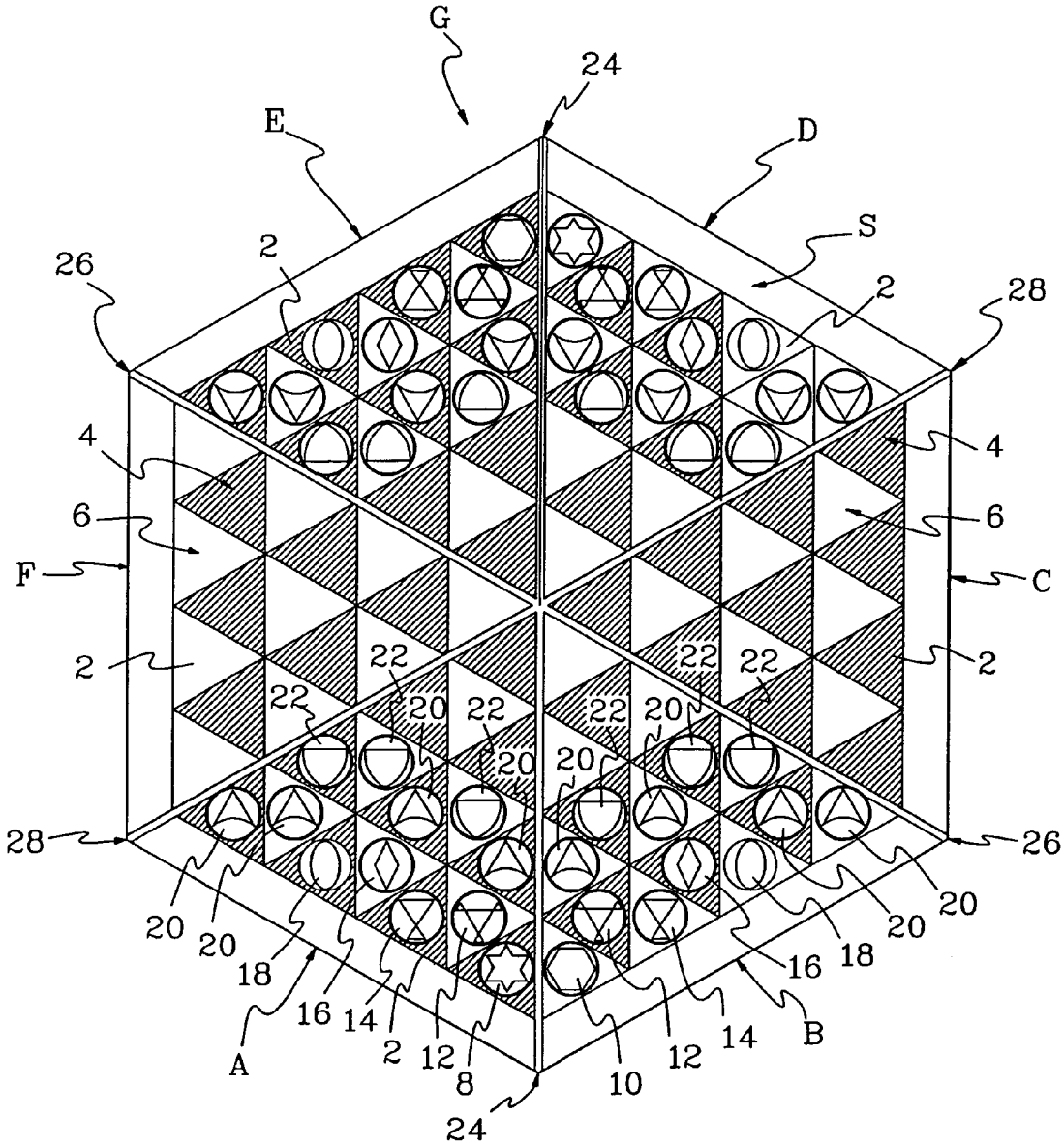
FIG. 1 is a top plan view showing the gameboard with indicia of game pieces as positioned initially prior to play.
Figure 3:
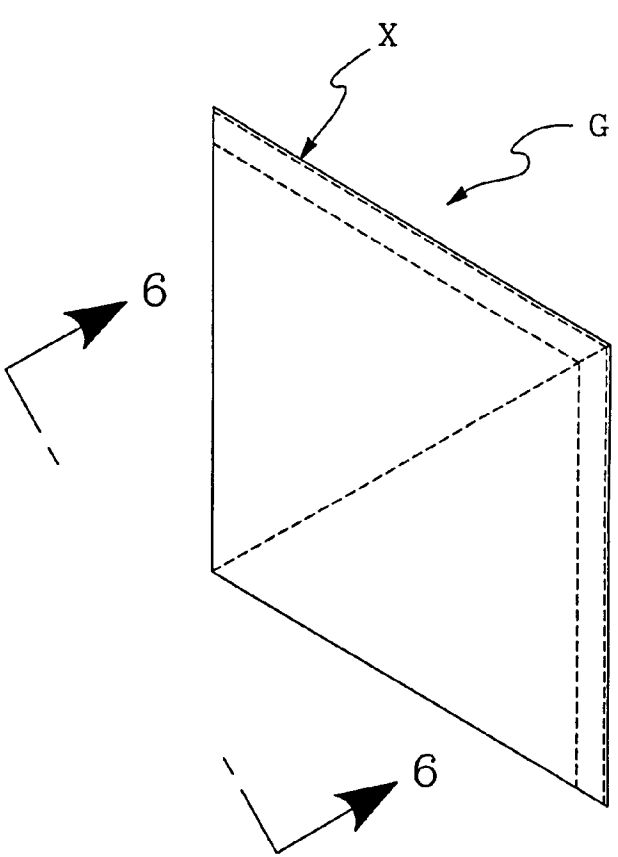
FIG. 3 is a top plan view of the gameboard when folded in diamond shape with portions shown in phantom lines.
Figure 2:
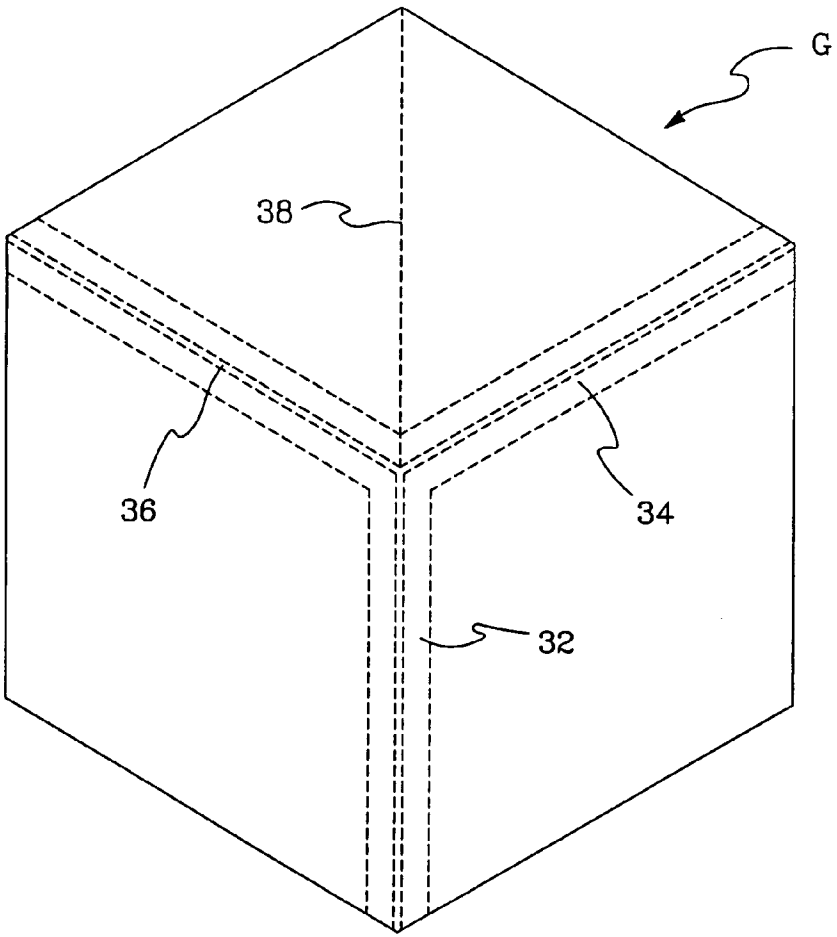
FIG. 2 is a bottom plan view of the gameboard portions of which are shown in phantom lines prior to folding.
Figure 6:
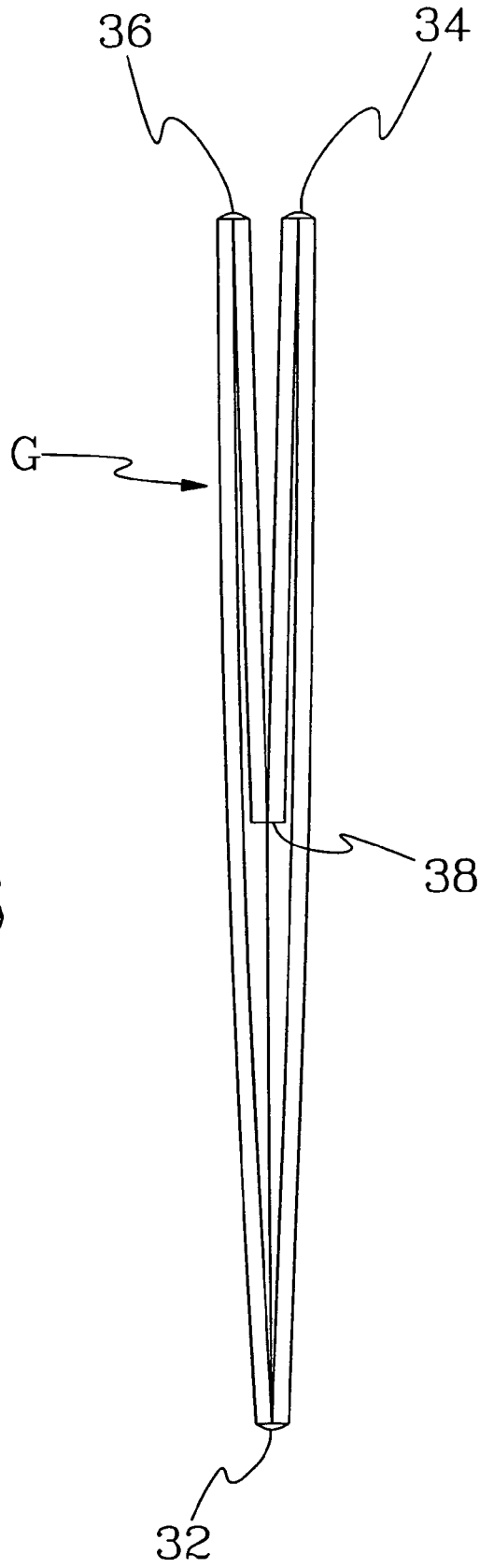
FIG. 6 is a side elevational view showing the gameboard when folded in the diamond shape of FIG. 3 and viewed in the direction of the arrows 6-6.

FIG. 2 shows the fold lines 32, 34, 36 and 38. Fold lines 32, 34 and 36 fold inwardly from the top surface S of the board G. Fold line 38 folds inwardly from the bottom surface T. When the folds 32, 34, 36 and 38 are made, the result will be a diamond configuration X as shown in FIG. 3. FIG. 6 shows the folds of 32, 34, 36 and 38 when the board is in the diamond configuration.

Figure 4:
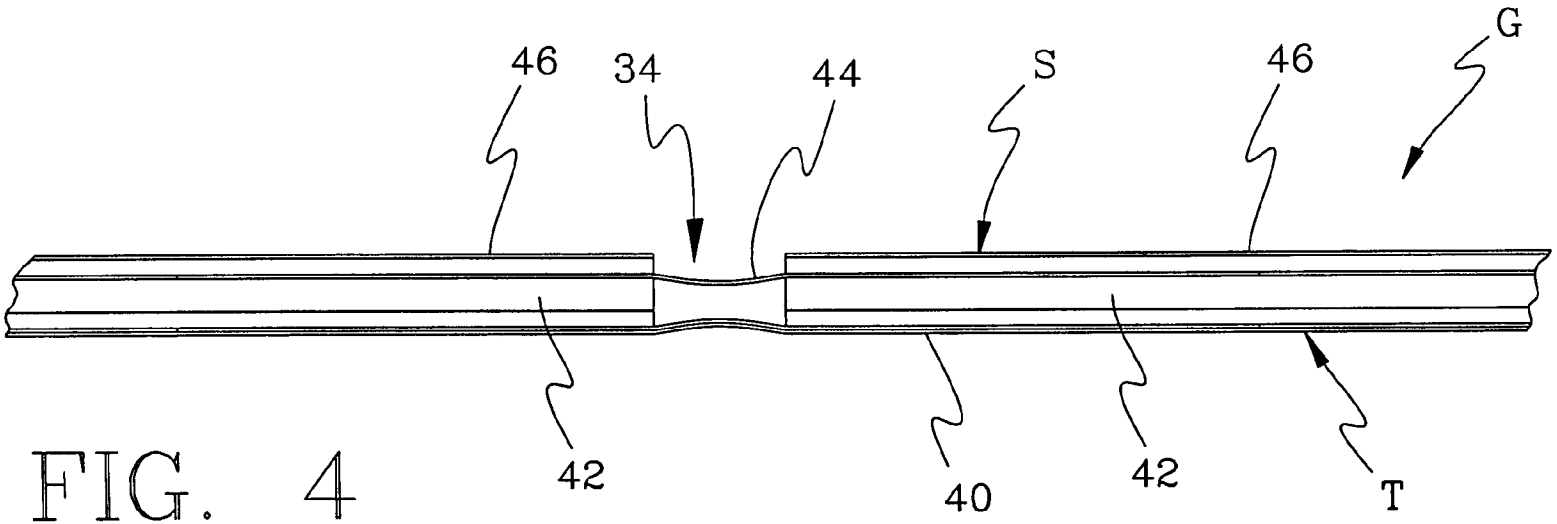
FIG. 4 is an enlarged fragmentary elevational end view of the gameboard as shown in FIG. 2 and viewed from the bottom edge of the gameboard in FIG. 2.
Figure 5:
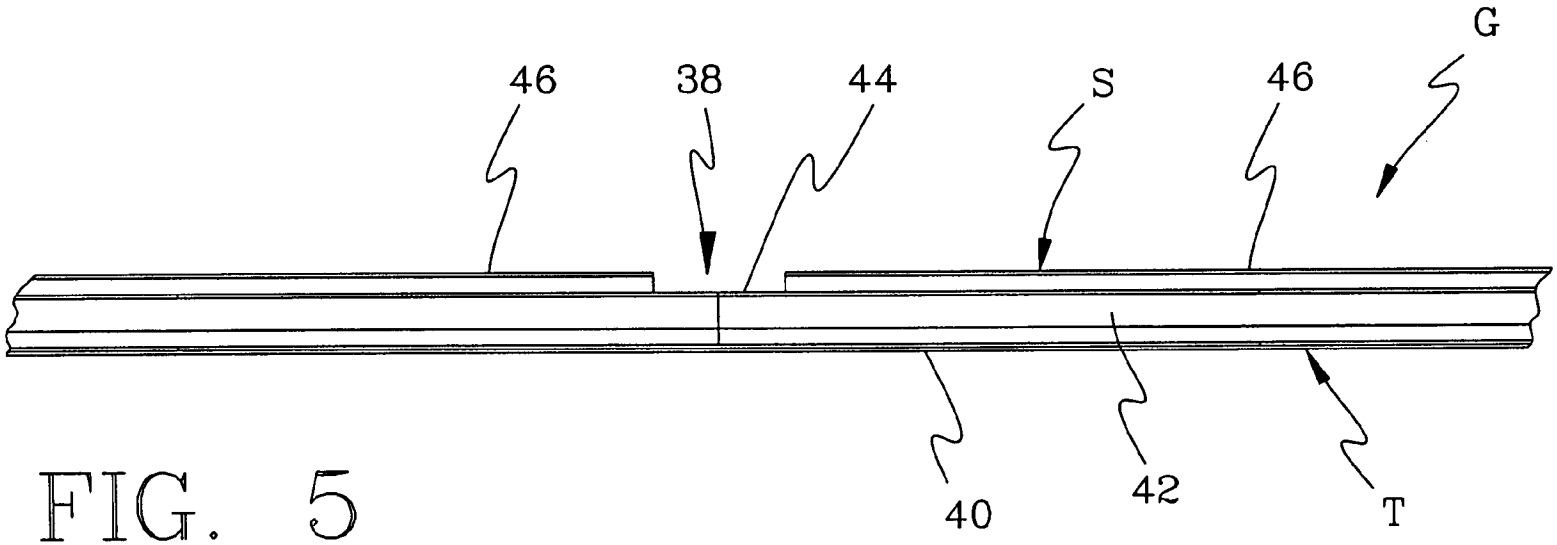
FIG. 5 is a fragmentary enlarged end elevational view of the gameboard shown in FIG. 2 and viewed from the top edge of the gameboard in FIG. 2.

FIGS. 4 and 5 show enlargements of the fold areas 34 and 38 when the board is laying flat. In FIG. 4, the board comprises a series of laminates beginning with a bottom laminate 40 of flexible plastic or leather or the like. A one or multiple ply laminate may be of cardboard or other similar material. A second flexible laminate 44 is applied to the laminate 42 and it would be made of plastic or leather or the like. On the flexible laminate 44 is applied the printed gameboard surface laminate 46 which may be of a foil or a plastic or the like. It is to be noted for the purposes of folding along the fold line 34, the laminates 42 and 46 are spaced in order to provide ease in folding. The flexible laminate 44 is not severed as in FIG. 5 since the fold is upward from the top surface S whereas in FIG. 5 the laminate 44 is cut so that the fold will be in a downward direction inward of the bottom surface of the board G.

THE GAME IN GENERAL

As has been pointed out but not shown in the drawings, the various minor triangular segments are numbered from 1 to 16 in each major segment to provide a system of coordinates to position each one of the games pieces and to permit the information to be processed in order to develop a game that can be played on a computer. As to the game pieces which may be of any selected design, the moves are as follows:

a. Squires and Archers: They move through the sides left and right of the triangle, always in a direction to the front and towards their adversaries, capturing at the vertexes. These two possibilities of movement are allowed because of the relation of one triangle with another adjacent one.

b. Monks: These characters move through a diamond shape in the board from the union of 13 triangles, using only the spaces whose color corresponds to each monk.

c. Wizards: These characters take advantage of the capacity of triangles to form rhombuses, and move through them, either setting off from one side of the triangle or from its vertex, in any direction through the rhombuses' larger diagonals.

d. Princes: They move two spaces between the vertexes or through the sides of the triangle where they are positioned falling on a third space to the right or to the left, depending on the player's decision.

e. Princesses: They move through the line that joins several triangles of the same color, being able to move in any direction.

f. Kings: These monarchs incorporate the moves of back the wizard and princess.

g. Kingdom: Just like the monk, it takes advantage of the diamond shape provided by the board and its triangles, with the difference that it can move to all and each one of the triangles adjacent.

The play of the game shows the players the consequences of their actions and the sense of responsibility implied both in the game and in real life. The result is an excellent game that encourages responsibility on a daily basis and at the same time reinforces different capacities like patience, observation and reflection.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A two player game apparatus comprising:

a) a hexagonal gameboard having six equal sides;

b) said gameboard having a playing field having a center point with six major equilateral triangular segments extending from said center point and each major equilateral triangular segment having a base adjacent one of said six equal sides;

c) said major segments each defined by 16 equilateral minor triangles;

d) said 16 equilateral minor triangles of each of said six major equilateral triangular segments comprising first, second, third, fourth, fifth, sixth and seventh rows beginning at each of said six major equilateral triangular segments base and ending at said center point;

e) only a first two adjacent major equilateral segments and only a second two adjacent major equilateral triangular segments opposite to only said first two adjacent major equilateral segments have game piece indicia;

f) said game piece indicia on said first two adjacent major equilateral segments and said opposite second two adjacent major equilateral segments being only on said first, second, third and fourth rows of said equilateral minor triangles and said fifth, sixth and seventh rows of said equilateral minor triangles having no game piece indicia;

g) said first, second, third and fourth rows of said first and second two adjacent major equilateral segments comprising 24 triangles selectively marked for seven different value game pieces; and h) said minor triangles being of two alternating colors.

2. Game apparatus as in claim 1, wherein:

a) said gameboard has a front surface and a back surface;

b) said front surface has three inside fold lines; and c) said back surface has one inside fold line.

3. Game apparatus as in claim 2, wherein:

a) said gameboard comprises a one piece bottom flexible laminate;

b) two stiff diamond members and two stiff triangular members bonded to said one piece bottom flexible laminate and spaced a slight distance from each other producing four fold lines;

c) flexible top laminate bonded to said two stiff diamond members and said two adjacent stiff triangular member, and d) printed playing field top laminated bonded to said two stiff diamond members and said two stiff triangular members.

* * * * *